US008540345B2

(12) United States Patent
Mochizuki et al.

(10) Patent No.: US 8,540,345 B2
(45) Date of Patent: Sep. 24, 2013

(54) RECORDING APPARATUS AND RECORDING SYSTEM

(75) Inventors: Yugo Mochizuki, Kawasaki (JP); Akitoshi Yamada, Yokohama (JP); Fumitaka Goto, Tokyo (JP); Tomokazu Ishikawa, Kawasaki (JP); Takashi Nakamura, Yokohama (JP); Okinori Tsuchiya, Yokohama (JP); Akihiko Nakatani, Kawasaki (JP); Mitsuhiro Ono, Tokyo (JP); Ayumi Sano, Kawasaki (JP); Takashi Fujita, Kawasaki (JP); Hidetsugu Kagawa, Kawasaki (JP); Fumihiro Goto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 85 days.

(21) Appl. No.: 12/965,707

(22) Filed: Dec. 10, 2010

(65) Prior Publication Data

US 2011/0148964 A1 Jun. 23, 2011

(30) Foreign Application Priority Data

Dec. 22, 2009 (JP) ..... 2009-290108

(51) Int. Cl.
*B41J 2/155* (2006.01)

(52) U.S. Cl.
USPC ..... 347/42; 347/13; 347/14

(58) Field of Classification Search
USPC ..... 347/5, 14, 15, 19, 12, 13, 42, 43
See application file for complete search history.

(56) References Cited

U.S. PATENT DOCUMENTS

| | | | | |
|---|---|---|---|---|
| 6,834,932 | B2 * | 12/2004 | Silverbrook et al. | 347/42 |
| 7,513,599 | B2 * | 4/2009 | Wada et al. | 347/42 |
| 2005/0073707 | A1 | 4/2005 | Yamazoe | |
| 2007/0120883 | A1 | 5/2007 | Tsuboi | |
| 2008/0204816 | A1 | 8/2008 | Miyazaki | |

FOREIGN PATENT DOCUMENTS

| | | |
|---|---|---|
| JP | 2005-110089 A | 4/2005 |
| JP | 2007-152582 A | 6/2007 |
| JP | 2008-209436 A | 9/2008 |

* cited by examiner

*Primary Examiner* — Lam S Nguyen
(74) *Attorney, Agent, or Firm* — Canon USA Inc. IP Division

(57) ABSTRACT

When a gradation mask is used to distribute image data to be recorded by overlapping portions in an overlapping head, color unevenness is generated in an image recorded by the overlapping portions due to a displacement in impact positions caused by an assembly error. As a result, accurate colorimetric measurement of patches recorded by the overlapping portion cannot be performed. To solve such a problem, a distribution ratio by which the image data is distributed to the overlapping portions is set to be approximately constant when recording a test pattern for performing color correction, as compared to when normally recording the image.

13 Claims, 18 Drawing Sheets

RECORDING APPARATUS AND RECORDING SYSTEM

BACKGROUND OF THE INVENTION

1. Field of the Invention

The present invention relates to a recording apparatus and a recording system that uses an overlapping head in which a plurality of recording heads is arranged to overlap with one another. In particular, the present invention relates to a recording apparatus and a recording system that performs color correction by performing colorimetric measurement of a test pattern.

2. Description of the Related Art

Image recording apparatuses such as a printer use various recording methods. In particular, a printer using an inkjet recording method can be widely applied to consumer products and to large size recording printers for industrial use. In general, an inkjet recording apparatus discharges ink from a recording head including a discharge port array formed of a plurality of discharge ports, and records an image on a recording medium.

Along with the wide spread use of such inkjet recording apparatuses, there are proposals on improving the recording method to improve quality of images recorded by the ink jet recording apparatus. For example, Japanese Patent Application Laid-Open No. 2008-209436 discusses a color correction method in which the test pattern formed of a plurality of patches of different colors is recorded. The recorded patches are read by a density meter or a colorimeter, and correction data is generated based on the read data.

The inkjet printer employs various recording methods, such as a serial recording method for recording by scanning the recording head with respect to the recording medium. Further, there is a full line recording method for recording by conveying the recording medium with respect to a full line head formed by arranging a plurality of recording head chips. A width that can be recorded by the full line recording head corresponds to the width of the recording medium in the full line recording method. Recording can thus be performed by conveying the recording medium in a direction perpendicular to the direction of the discharge port array, so that high speed recording can be performed.

A recordable area of such a full line recording head can be elongated by connecting recording head chips of the same color. According to the present invention, a full line head formed by connecting a plurality of recording head chips will be referred to as an overlapping head. In general, the overlapping head is formed by overlapping and connecting a portion (i.e., an overlapping portion) of each of the plurality of recording head chips. The overlapping head then records by distributing the image data to be recorded to the overlapping portions of each of the recording head chips.

Conventionally, there are various methods for reducing color unevenness or streaks caused by an assembly error of the recording head chips that occurs when the overlapping head is manufactured. Such color unevenness and streaks will be described in detail below with reference to FIGS. 2A, 2B, and 2C.

FIG. 2A illustrates an overlapping head formed by connecting recording head chips A and B. According to the present invention, overlapping portions of each of the chips which overlap with each other will be referred to as overlapping portions, and the portions that do not overlap will be referred to as non-overlapping portions. Referring to FIG. 2A, there are overlapping portions 172 and 173, and non-overlapping portions 171 and 174. It is necessary to assemble the overlapping head so that the positions of the overlapping portions 172 and 173 completely overlap. However, the overlapping portions of each of the chips may become slightly displaced due to the assembly error that occurs when manufacturing the overlapping head.

If the image data is then distributed to such an overlapping head including displacement, image quality is degraded. FIG. 2B illustrates an example in which the image data to be recorded by the overlapping portions of the chips A and B are distributed so that distribution rate of the discharge ports in the overlapping portion 172 to those in the overlapping portion 173 becomes 50%-50%. FIG. 2B indicates that, when there is displacement due to the assembly error, there is an area which is recorded by only one of the chips, i.e., only 50% of the image data is recorded in the area.

As a result, a white streak as illustrated in FIG. 1 is generated in a boundary region between the area recorded by the overlapping portion and the area recorded by the non-overlapping portion of the overlapping head. The white streak is generated in the example illustrated in FIG. 2B due to the displacement caused by the overlapping portions of the two chips that are apart from each other. However, if the displacement is generated by the overlapping portions excessively overlapping with each other, the image data becomes recorded by 150%, so that a black streak is generated.

To solve such image degradation, there is a method for distributing the image data to be recorded by the overlapping portions so that the distribution rate between each of the discharge ports gradually changes. This is as illustrated in FIG. 2C. For example, Japanese Patent Application Laid-Open No. 2007-152582 discusses such a method. A drastic increase in the number of discharge ports to be used is reduced by gradually distributing the image data. The generation of the streak in the boundary portion between the overlapping portion and the non-overlapping portion is thus reduced.

On the other hand, the inventors of the present invention have found that a problem other than the white streak and the black streak is generated as image degradation due to the assembly error of the recording head chip. More specifically, the colors (i.e., elements such as a color hue, saturation, and intensity) become different by the displacement of impact positions of ink droplets due to the assembly error. In such a case, the color recorded by the overlapping portions becomes different from the color recorded by the non-overlapping portions, even when the color of the image recorded by the non-overlapping portions of the chips is the same. Such a case will be described in detail below with reference to FIGS. 3A, 3B, 3C, and 3D.

FIG. 3A illustrates a state in which there is a small assembly error in the recording head chips A and B. Referring to FIG. 3A, the recording head chips A and B discharge the same amount of the same color ink, and the color to be recorded by the each of the non-overlapping portions is the same. FIGS. 3B and 3C illustrate the image recorded by the overlapping portions, i.e., an arbitrary pixel whose gradation is expressed by nine dots. Such an image is created by distributing the image data to the chip A and the chip B using a staggered pattern mask, and all of the nine dots are printed in the image.

More specifically, FIG. 3B illustrates an example of a case where there is no assembly error, as compared to FIG. 3C in which there is an assembly error. Referring to FIG. 3B, the impact error of the ink dots due to the assembly error is not generated, and the dots are printed without overlapping with each other.

On the other hand, referring to FIG. 3C, since the impact positions of the ink dots are displaced due to the assembly error, the dots discharged from the chip A and the dots discharged from the chip B overlap on the recording medium. Since the color of the image becomes different depending on coverage or an overlapping rate of the dots on the recording medium, the colors of the pixels become different even when both are formed of the same nine dots.

In other words, when there is no assembly error as illustrated in FIG. 3B, the colors generated by the non-overlapping portions and the overlapping portions become the same. However, if there is an assembly error as illustrated in FIG. 3C, the colors generated by the non-overlapping portions and the overlapping portions become different. Further, if a plurality of such pixels is collected together, a considerable difference between the colors becomes generated.

Such a difference between the colors of the non-overlapping portions and the overlapping portions may be generated for all overlapping portions. More specifically, when the recording head formed by connecting a plurality of the same color chips is used in recording as illustrated in FIG. 3D, a color deviation is generated due to the impact error. The color deviation is generated at a number of positions equal to the number of overlapping portions (i.e., number of chips—1). The color deviation becomes visible as a streak of a different color on the recorded image and thus causes image degradation. It thus becomes necessary to assemble the recording head chips with high precision to prevent generation of the color deviation, which increases cost.

Such a color deviation caused by the overlapping dots cannot be reduced even when using a gradation mask discussed in Japanese Patent Application Laid-Open No. 2007-152582. As described above, the gradation mask is used to gradually distribute the image data to be recorded to the discharge ports of the overlapping portions so that discharge port distribution rate gradually changes. The gradation mask thus does not reduce the overlapping caused by the displacement in the dot impact positions.

In general, the color deviation can be corrected using a correction method discussed in Japanese Patent Application Laid-Open No. 2008-209436. More specifically, colorimetric measurement is performed on the test patterns recorded by each of the overlapping portions and the non-overlapping portions, and the difference in the colors is reduced by performing color correction based on the colorimetric results.

However, when the discharge port distribution rate of the overlapping portions is determined using the gradation mask discussed in Japanese Patent Application Laid-Open No. 2007-152582, the difference in the colors cannot be accurately corrected using the correction method discussed in Japanese Patent Application Laid-Open No. 2008-209436. Such a case will be described in detail below with reference to FIGS. 4A, 4B, 4C, 4D, and 4E.

FIG. 4A illustrates the overlapping head formed by connecting the recording chip A and the recording chip B. The image data to be recorded by the overlapping portions is then distributed using the gradation mask that gradually distributes the image data as illustrated in FIG. 4B. FIGS. 4C, 4D, and 4E illustrate a plurality of patches recorded using such an overlapping head. FIG. 4C illustrates the patch recorded by the non-overlapping portion of the chip A, and FIG. 4E illustrates the patch recorded by the non-overlapping portion of the chip B. Each of such patches is recorded by only one of the chips. FIG. 4D illustrates the patch recorded by the gradation mask distributing the image data to the overlapping portions of the chip A and the chip B.

Referring to FIGS. 4C and 4E, the patches recorded by the non-overlapping portions are of the same color, and the color within each patch is uniform. On the other hand, referring to FIG. 4D, the color of the image recorded in the patch by the overlapping portions is different from the patch recorded by the non-overlapping portion due to the overlapping of the dots caused by the impact position displacement.

In particular, since the gradation mask distributes the image data, the discharge port distribution rate of the two chips gradually changes in the direction of the discharge port array. As a result, the displacement of the impact position, i.e., an amount of the dots overlap, becomes different depending on the position, so that the color of the image within the patch does not become uniform. In other words, if the gradation mask is used for the overlapping portions, the color unevenness is generated within the recorded patch. As a result, the color deviation cannot be accurately corrected even when using the colorimetric data acquired by performing colorimetric measurement of the patch.

Further, the overlapping portion is a very narrow region, i.e., 1 to 2% of the recording head chip. For example, if the width of the recording head chip is 1 inch, the width of the overlapping portion is approximately 2 mm. As a result, a current colorimeter cannot correctly perform colorimetric measurement of an image of a narrower width, even when the patch is recorded by dividing the area of an uneven color into a plurality of areas.

SUMMARY OF THE INVENTION

The present invention relates to a recording apparatus capable of recording a test pattern on which colorimetric measurement is performed for appropriately correcting a color of an area recorded by an overlapping portion of an overlapping head.

According to an aspect of the present invention, a recording apparatus includes a recording unit configured to record an image on a recording medium using a recording head in which a first recording element array including a plurality of recording elements aligned along a predetermined direction and a second recording element array including a plurality of recording elements aligned along the predetermined direction, are arranged to be displaced in the predetermined direction so that there is an overlapping portion formed by an end of the first recording element array and an end of the second recording element array overlapping along a direction perpendicular to the predetermined direction, a first distribution unit configured to distribute test pattern data to a first recording element array and a second recording element array in the overlapping portion, a generation unit configured to generate, based on a colorimetric result of a test pattern recorded according to data distributed by the first distribution unit, recording data corresponding to an image that is different from the test pattern, a second distribution unit configured to distribute recording data generated by the generation unit to a first recording element array and a second recording element array in the overlapping portion, and a control unit configured to control the first distribution unit and the second distribution unit so that an amount of change in a distribution ratio from a center to an end of the first and the second recording element arrays by the first distribution unit becomes smaller than an amount of change in a distribution ratio from a center to an end of the first and the second recording element arrays by the second distribution unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

<A Recording Apparatus>

Figure 5:
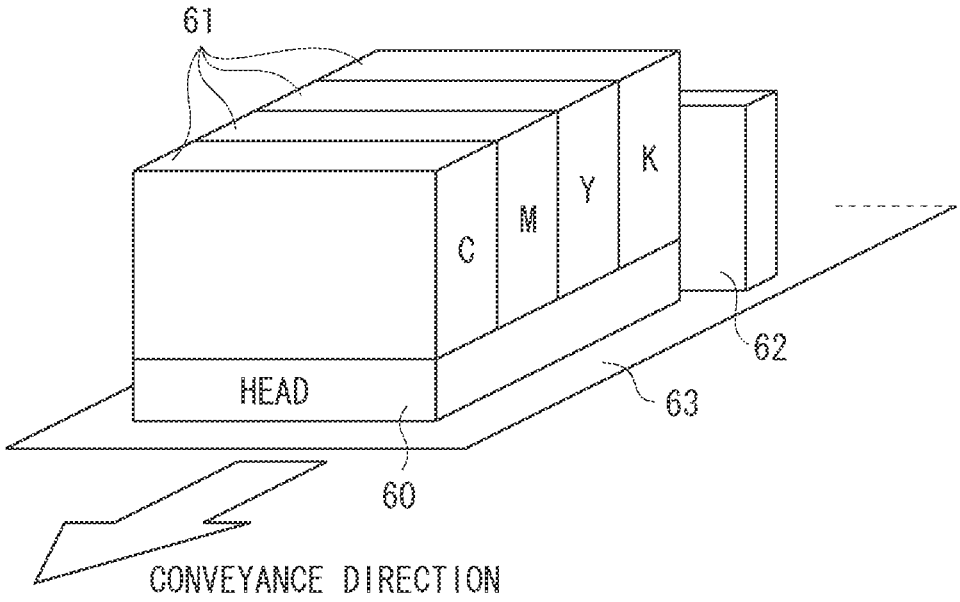
FIG. 5 illustrates a configuration of a recording apparatus according to a first exemplary embodiment of the present invention.

FIG. 5 is a schematic diagram illustrating an inkjet recording apparatus according to the present exemplary embodiment. Referring to FIG. 5, a head 60 includes ink containers 61 that contain inks, i.e., recording materials. A control circuit unit 62 includes a read-only memory (ROM) 74 and a random access memory (RAM) 75, i.e., storing units that are necessary when driving the head unit 60 as will be described below. The control circuit unit 62 also includes a central processing unit (CPU) 72, i.e., a calculation unit, and an interface, i.e., a communication unit.

The head 60 receives a recording signal and a control signal from the control circuit unit 62, and discharges ink from the discharge ports of a recording element (nozzles) based on the recording signal and according to the control signal. A conveyance roller (not illustrated) conveys on a supporting stage (not illustrated) a recording medium 63 in a conveyance direction (i.e. a scanning direction). The image is thus recorded on the recoding medium by such a configuration. FIG. 5 illustrates an example in which the ink containers 61 contain four colors, i.e., cyan (C), magenta (M), yellow (Y), and black (K). However, the present invention is not limited to such an example.

Figure 6:
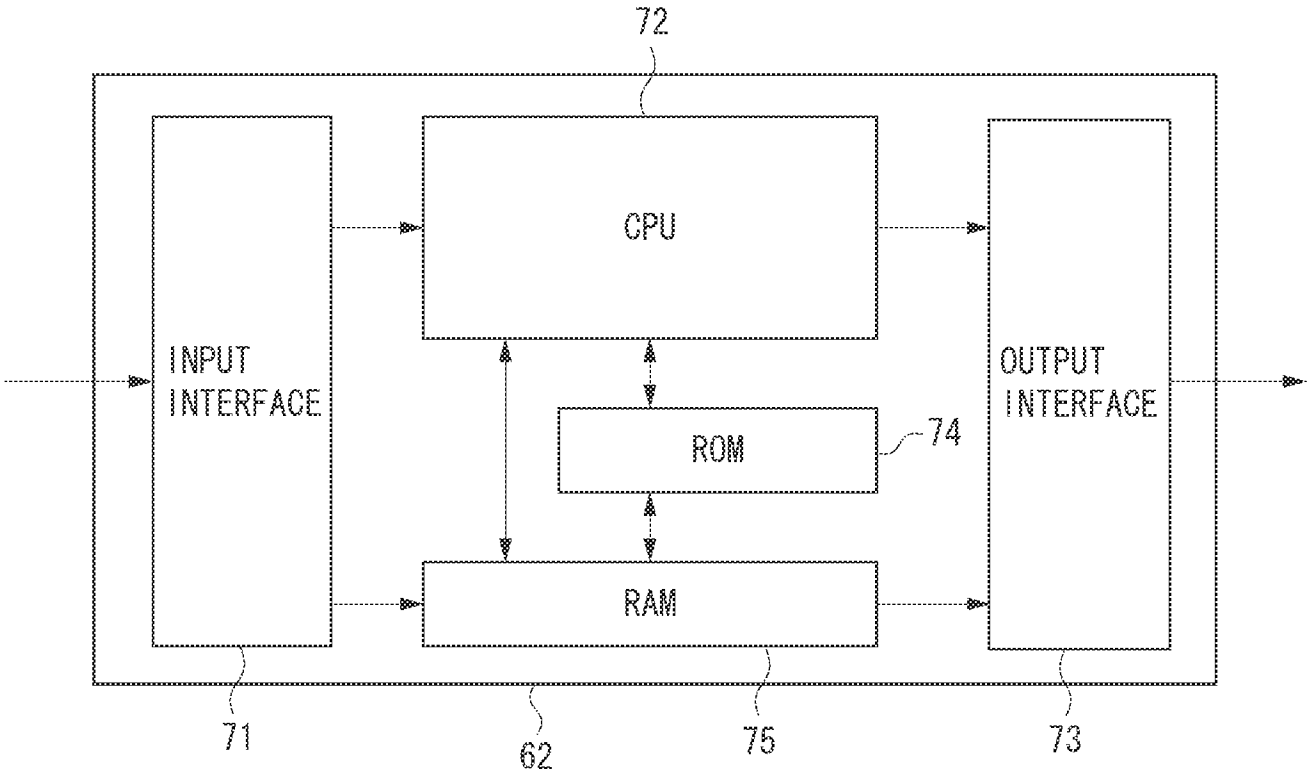
FIG. 6 illustrates an internal configuration of the recording apparatus according to the first exemplary embodiment of the present invention.

FIG. 6 is a block diagram illustrating the control circuit unit 62 in the inkjet recording apparatus illustrated in FIG. 5. Referring to FIG. 6, the control circuit unit 62 includes an input interface 71, the CPU 72, an output interface 73, the ROM 74, and the RAM 75. The input interface 71 receives as an external input from an operation unit of a printer (not illustrated) or a computer (not illustrated) the image signal and the control signal including head drive signal. The input interface 71 then transmits to the RAM 75 or the CPU 72 the image signal to be recorded or the control signal including the drive signal, and the signals are processed as appropriate.

At that time, the CPU 72 executes a control program stored in the ROM 74 or performs signal processing. The output interface 73 then outputs to the head 60 the processed image signal and the control signal including head drive signal. The head 60 thus receives the image signal to be recorded and the control signal including the head drive signal corresponding to the image signal, and is driven to record the image. The ROM 74 may be a writable non-volatile storage device.

<System Configuration>

Figure 7:
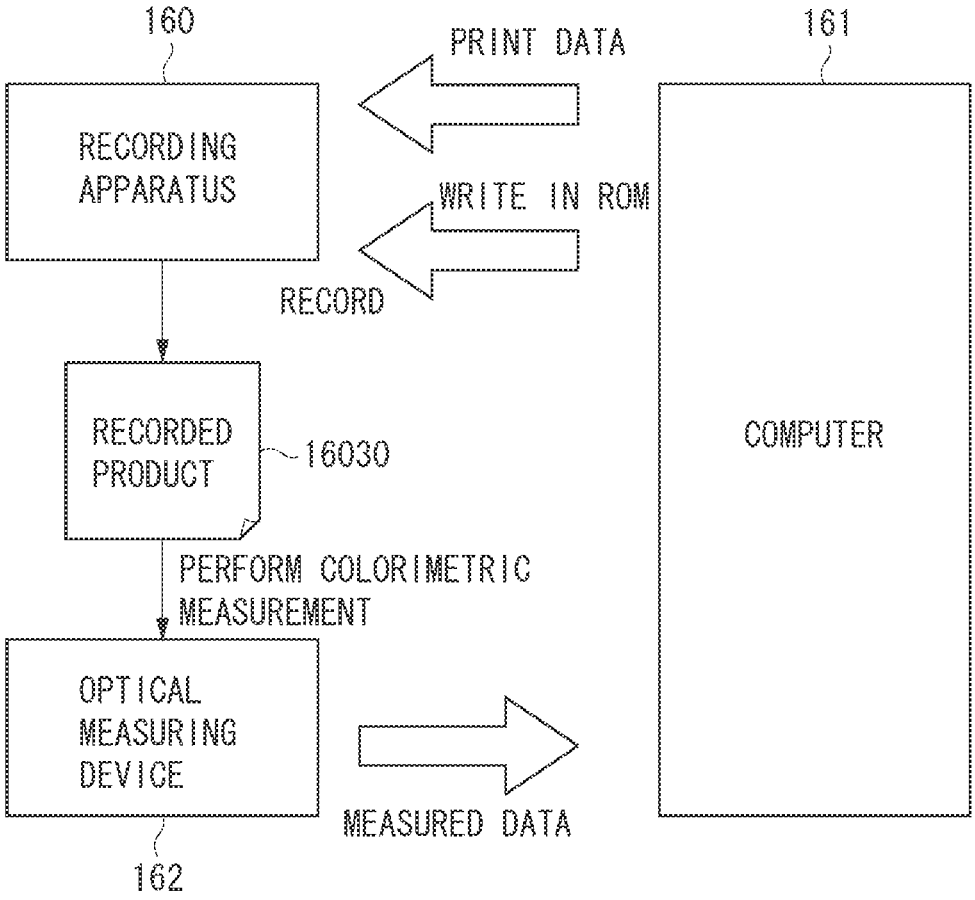
FIG. 7 illustrates a configuration outside the recording apparatus according to the first exemplary embodiment of the present invention.

FIG. 7 is a block diagram illustrating a system according to the present exemplary embodiment. Referring to FIG. 7, an inkjet recording apparatus 160 records the image using the control circuit unit 62 illustrated in FIGS. 5 and 6. Further, the inkjet recording apparatus 160 is capable of recording the image by directly receiving the image from a computer 161, i.e., an external apparatus that provides the recording data.

An optical measuring device 162, i.e., a measuring unit, optically measures the image recorded by the inkjet recording apparatus 160. All recorded products including a test pattern patch to be described below are optically measured. The measured data acquired by the optical measuring device 162 is transmitted to the computer 161, i.e., a correction unit. The inkjet recording apparatus thus records the data that the computer 161 has instructed to record, the optical measuring device 162 reads the recorded product, and the read data is transmitted to the computer 161.

As a result, the color signal which the computer 161 has instructed to record and the color signal read by the optical measuring device 162 can be compared. Further, the computer 161 is capable of rewriting the control program or a color correction table as necessary with respect to the ROM 74 included in the control circuit unit 62.

<Detailed Description of the Recording Unit>

Figure 8:
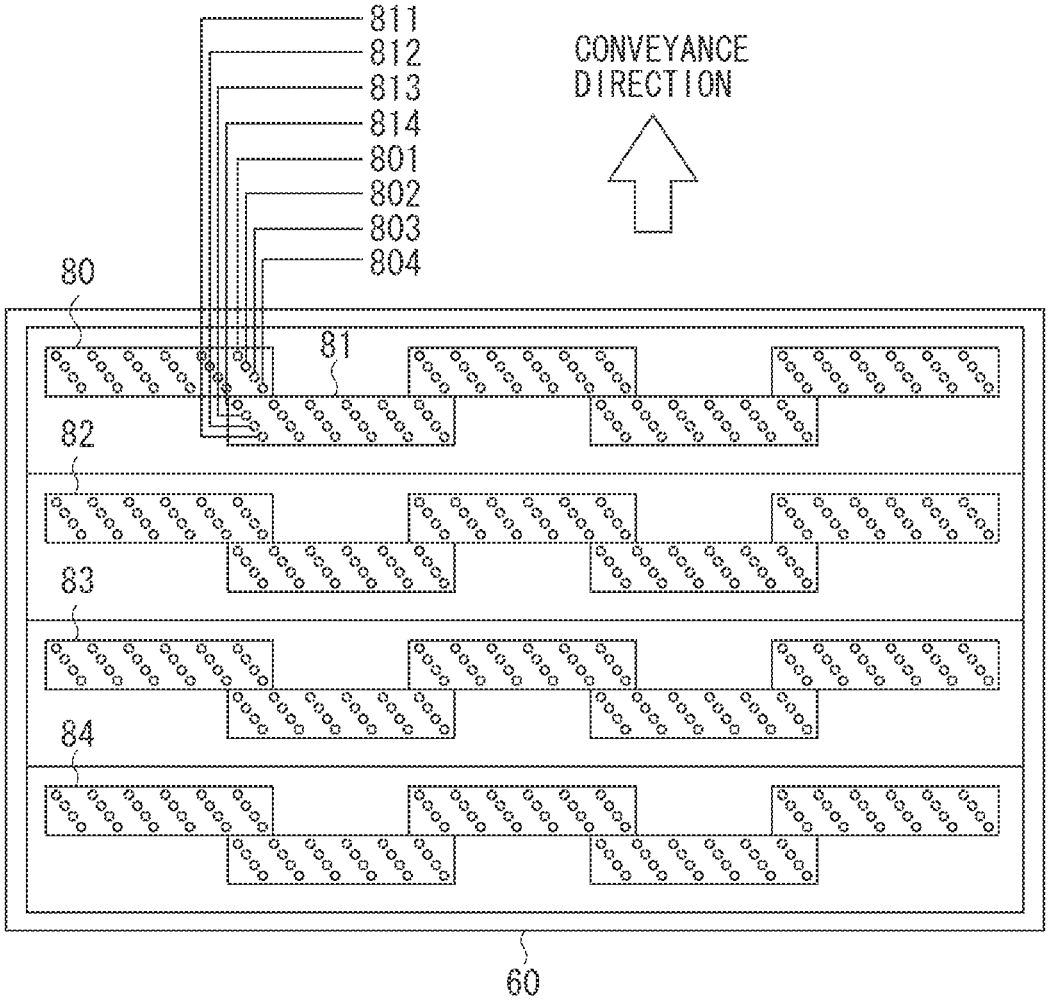
FIG. 8 illustrates the overlapping head according to the first exemplary embodiment of the present invention.

FIG. 8 is a schematic diagram illustrating the head 60. Referring to FIG. 8, a recording head chip 80 discharges cyan ink, a recording head chip 82 discharges magenta ink, a recording head chip 83 discharges yellow ink, and a recording head chip 84 discharges black ink. Further, a recording head chip 81 discharges cyan ink similarly as the recording head chip 80.

Discharge port arrays 801, 802, 803, and 804 in which the discharge ports that discharge the ink are aligned are arranged in the recording head chip 80. Similarly, discharge port arrays 811, 812, 813, and 814 are arranged in the recording head chip 81. In other words, a first recording element array (discharge port array) is arranged along a predetermined direction in the recording head chip 80, and a second recording element array (discharge port array) is arranged along a predetermined direction in the recording head chip 81.

Further, the recording head chip 80 and the recording head chip 81 are arranged to overlap along the conveyance direction (scanning direction) perpendicular to the direction of the discharge port arrays (i.e., the predetermined direction). The positions of the discharge ports in the overlapping portions correspond to the overlapped positions. Furthermore, according to the present exemplary embodiment, the overlapping portions of the recording head chips for each color are aligned to be at the same position on the recording medium. In other words, the overlapping portions of all ink colors are arranged to record on the same area on the corresponding recording medium.

<Flowchart>

Figure 9:
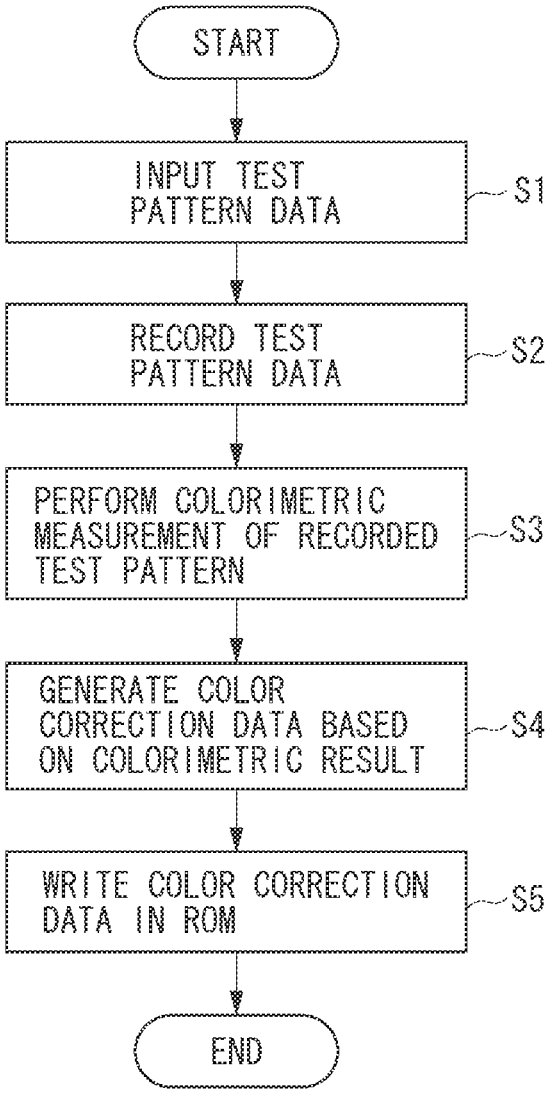
FIG. 9 is a flowchart illustrating a color correction data generation process according to the first exemplary embodiment of the present invention.

FIG. 9 is a flowchart illustrating a process for performing color correction. The color correction process according to the present exemplary embodiment is performed by recording the test pattern including a plurality of patches, performing colorimetric measurement of the test pattern, and generating the correction data.

In step S1, the computer 161 inputs to the recording apparatus 160 the test pattern data for recording the test pattern. In step S2, the recording apparatus 160 records the test pattern for performing color correction. The recording apparatus 160 records the test pattern on the areas of each of the overlapping portions and the non-overlapping portions of the recording head chips as will be described below. In such a case, the distribution ratio by which the test pattern data is distributed to the discharge ports in the overlapping portions of the two chips are is 50%-50% (according to the present invention, the distribution ratio of the data will also be referred to as a discharge port distribution rate).

In step S3, the optical measurement device 162 then performs colorimetric measurement of the recorded test pattern. In step S4, the computer 161 generates the color correction data based on the colorimetric result acquired by performing colorimetric measurement of the test pattern. In step S5, the recording apparatus 160 writes the generated color correction data in the ROM 74 therein.

Figure 10:
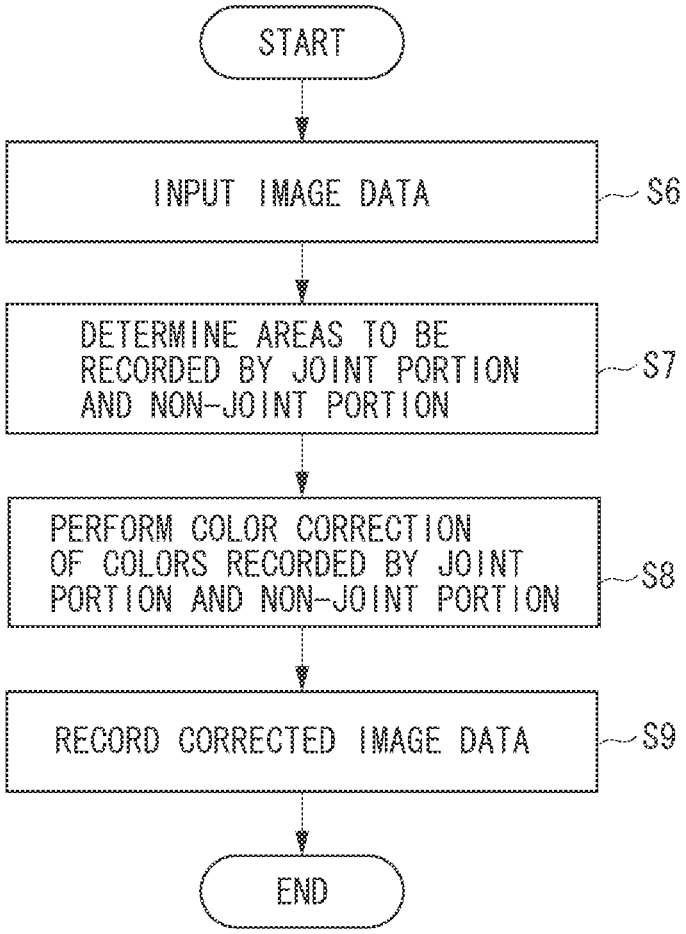
FIG. 10 is a flowchart illustrating a color correction process according to the first exemplary embodiment of the present invention.

A process for recording the image data after performing correction will be described below with reference to the flowchart illustrated in FIG. 10. In step S6, the computer 161 inputs to the recording apparatus 160 the image data to be recorded. In step S7, the recording apparatus 160 identifies the discharge ports in the chip 80 and the chip 81 that correspond to the subject pixel in the image data and determines the areas to be recorded by the overlapping portions and the non-overlapping portions.

In step S8, the recording apparatus 160 corrects the colors of the areas corresponding to the overlapping portions and the non-overlapping portions based on the color correction data generated by the process illustrated in the flowchart of FIG. 9. In step S9, the recording apparatus 160 records the corrected image data. In such a case, the discharge port distribution rate of the overlapping portions is determined by distribution of the image data by the gradation mask. The method for performing color correction will be described below.

<Test Pattern>

The test pattern to be recorded in step S2 illustrated in FIG. 9 will be described below with reference to FIGS. 11A and 11B. According to the present exemplary embodiment, the color difference generated in the image to be recorded by each of the overlapping portions and the non-overlapping portions of the recording head chips is corrected. It is thus necessary to generate a test pattern with respect to each of the overlapping portions and the non-overlapping portions.

Figure 11A:
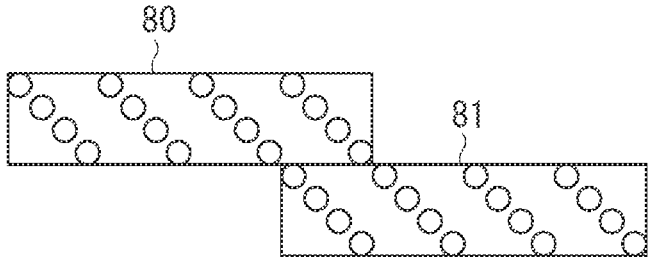
FIGS. 11A and 11B illustrate a test pattern according to the first exemplary embodiment of the present invention.
Figure 11B:
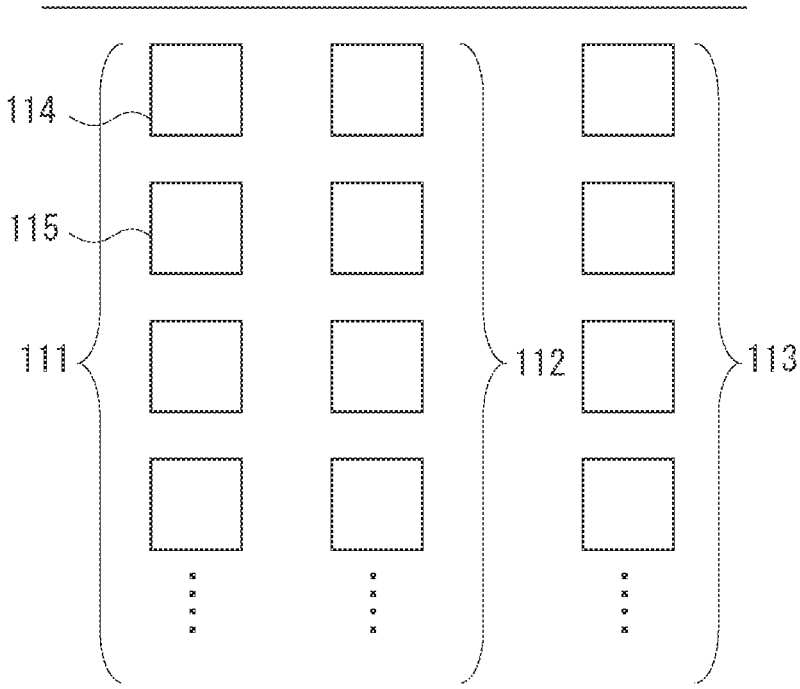

FIG. 11A illustrates the overlapping head in which the recording head chips 80 and 81 that discharge cyan ink as illustrated in FIG. 8 are connected. FIG. 11B illustrates patch groups in the test pattern recorded by the connection portions and the non-overlapping portions of the recording head chips 80 and 81. Referring to FIG. 11B, a patch group 111 includes a plurality of patches recorded by only the chip 80, i.e., the non-overlapping portion of the chip 80. Different color patches such as a patch 114 and a patch 115 are aligned in the patch group 111.

A patch group 113 is a patch group recorded by the non-overlapping portion of the chip 81, and a patch group 112 is a patch group recorded by the overlapping portions of the chip 80 and the chip 81. Different color patches as in the patch group 111 are aligned in both patch groups 113 and 112.

Figure 12A:
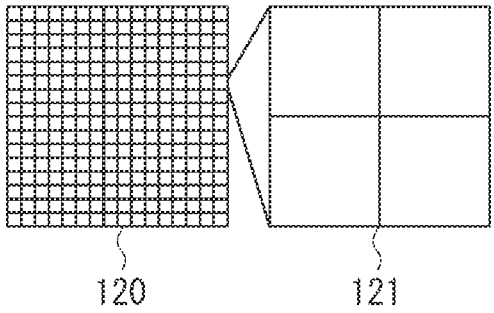
FIGS. 12A and 12B illustrate binary image data of the test pattern according to the first exemplary embodiment of the present invention.
Figure 12B:
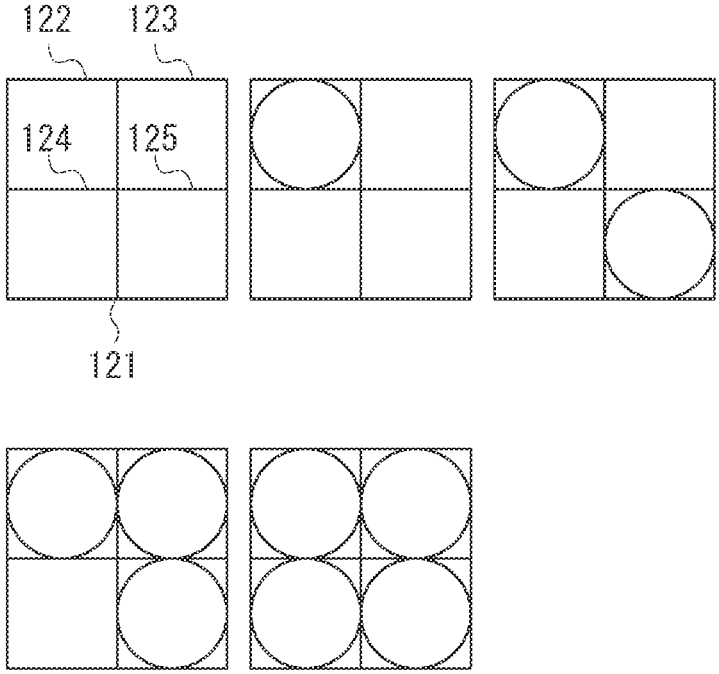

FIGS. 12A and 12B are schematic diagrams illustrating an enlarged pixel among a plurality of pixels that form the patch. According to the present exemplary embodiment, an example in which four dots express the gradation of 1 pixel will be described below.

FIG. 12A is an enlarged diagram illustrating a pixel 121 that is a pixel in a patch 120 formed of a plurality of pixels. FIG. 12B illustrates the pixel 121 divided into four small regions (hereinafter referred to as cells), and the ink droplets printed on each of cells 122, 123, 124, and 125. A gradation expression of five gradations can be expressed by recording a number of printed ink droplets in five steps, i.e., from zero to four droplets, with respect to the four cells.

As described above, according to the present invention, a collection of a plurality of pixels that are divided into cells which express one color is referred to as a patch. Further, a collection of a plurality of patches is referred to as a patch group. There is no particular limitation to the number of patches configuring the patch group. The test pattern formed of such patch groups is recorded by each of the overlapping portions and the non-overlapping portions of the chips. Such a test pattern is an example, and the patches recorded by each portion may be recorded at the same time or recorded separately.

A method for distributing the image data corresponding to the overlapping portions of the two chips as data to be recorded by each of the chips will be described below. There are various methods for generating the data, such as distributing the image data using the mask pattern, or sequentially assigning the image data according to a distribution ratio of the data to each chip. According to the present exemplary embodiment, the method for generating the image data to be recorded by each head by performing mask processing will be described.

A mask pattern indicates which one of the two chips is to discharge the ink, and the image data to be recorded by each chip can be generated by performing "AND processing" between the image data and the mask pattern.

Figure 1:
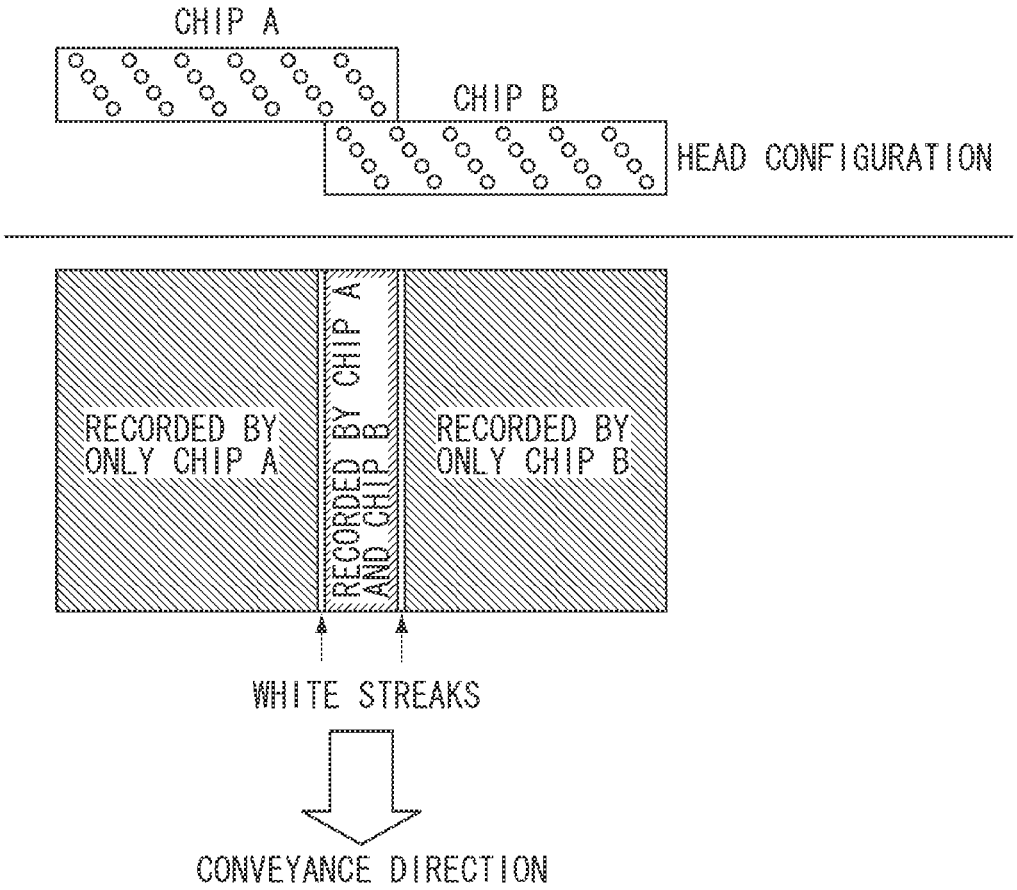
FIG. 1 illustrates a configuration of an overlapping head and a recorded image.
Figures 2A, 2B, 2C:
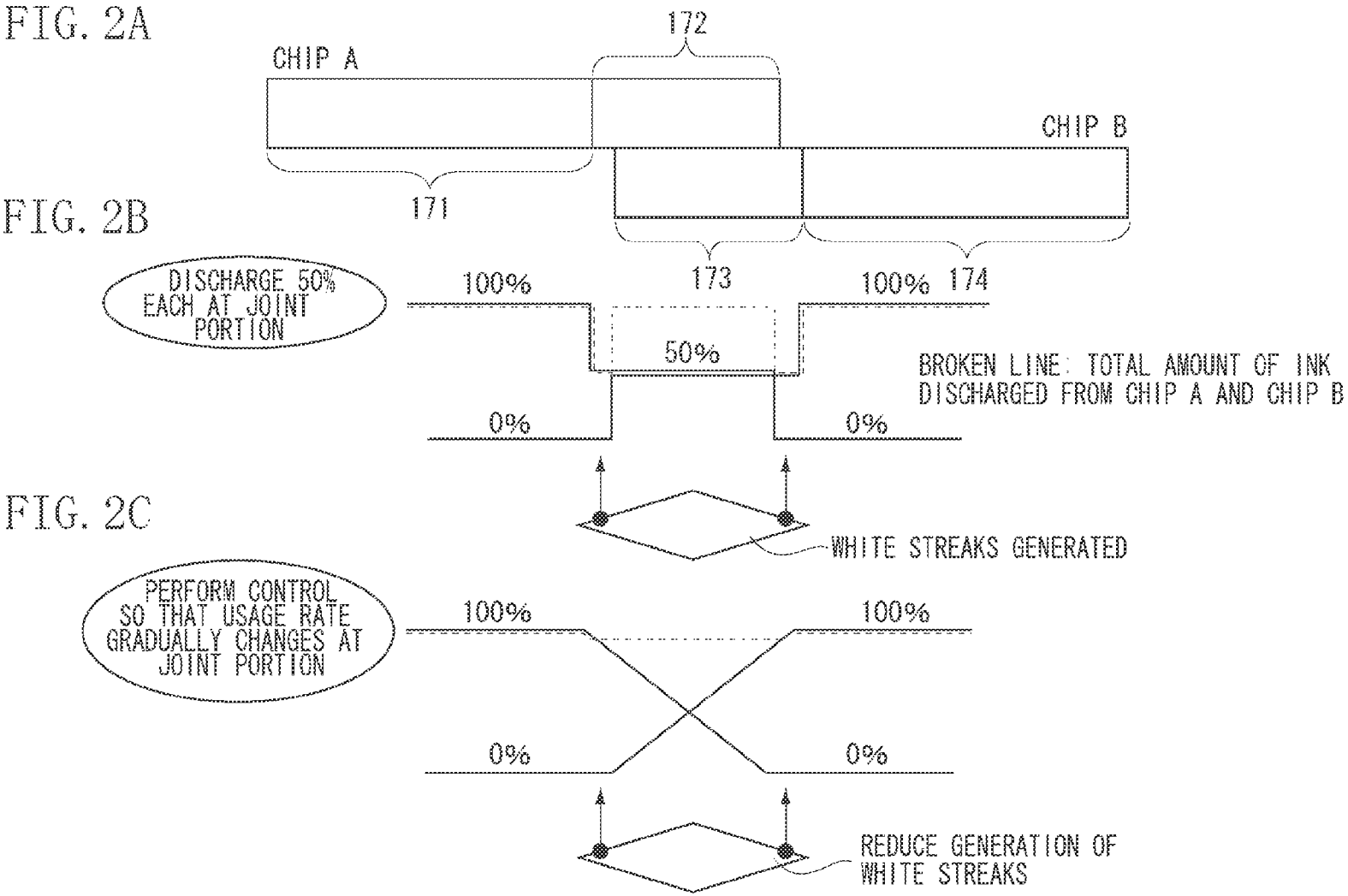
FIGS. 2A, 2B, and 2C illustrate image degradation due to a position displacement of the overlapping head.
Figure 3A:
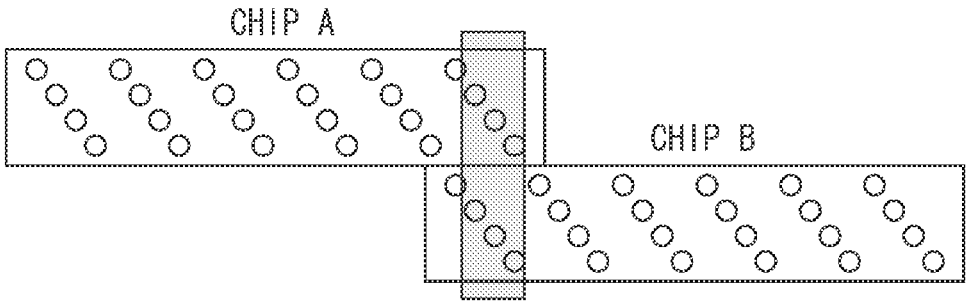
FIGS. 3A, 3B, 3C, and 3D illustrate dot overlapping due to the position displacement of the overlapping head.
Figure 3B:
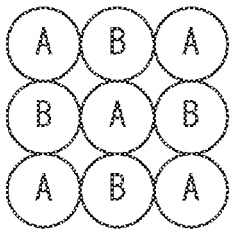
Figure 3C:
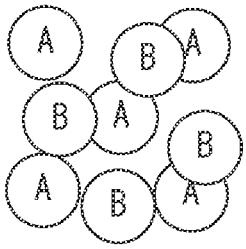
Figure 3D:
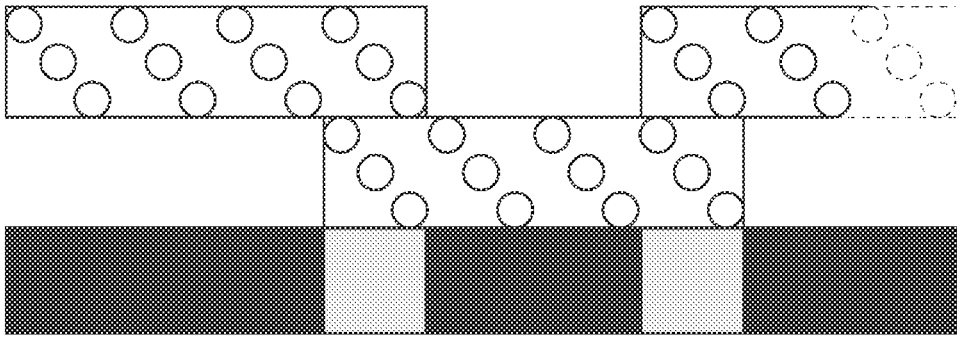
Figure 13:
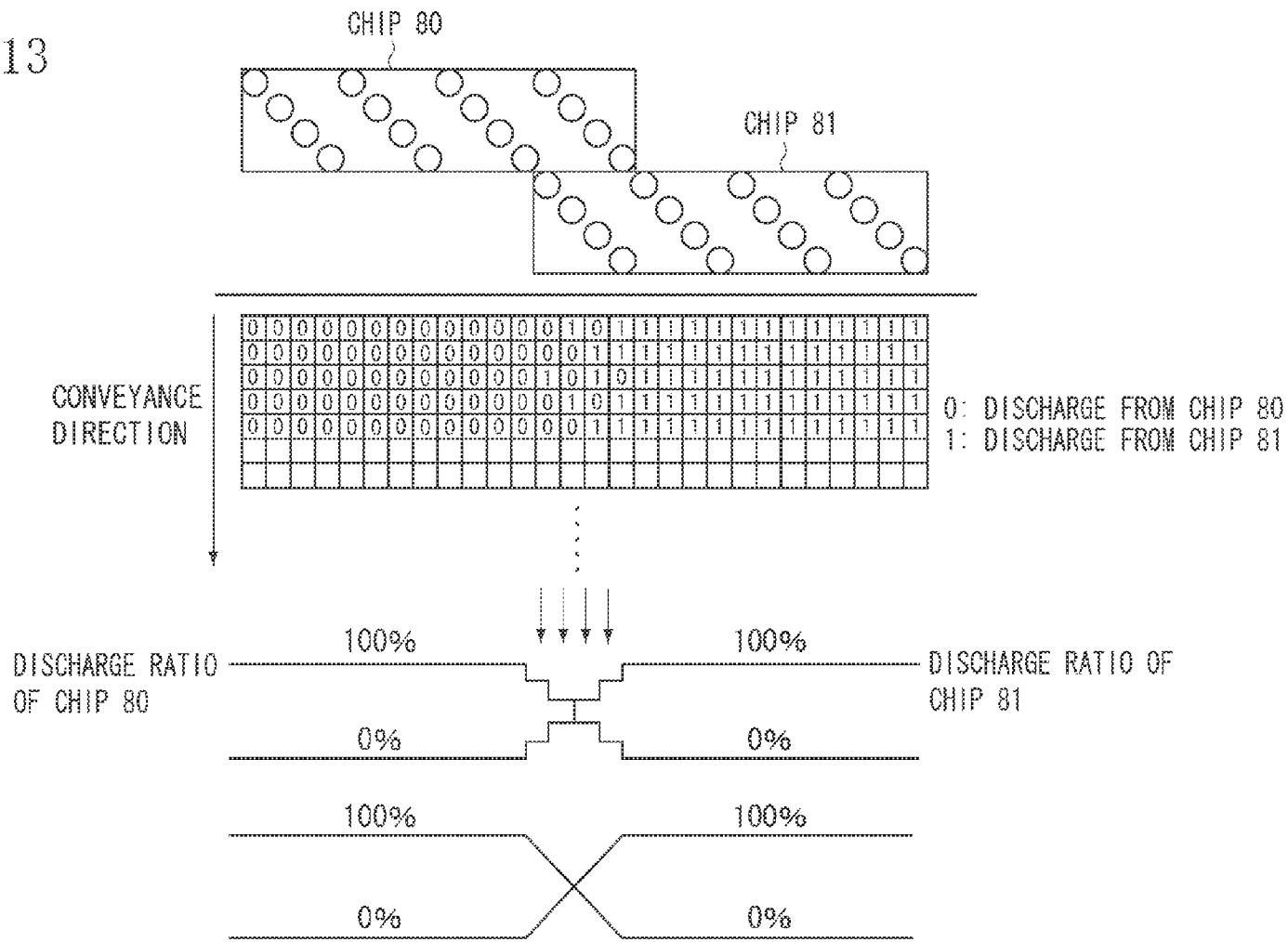
FIG. 13 illustrates distribution ratios of recording data when recording the image data.

FIG. 13 illustrates a case where the image data is distributed to the recording elements of each chip using the gradation mask described with reference to FIG. 2. The ratio of discharge port usage between the overlapping portion of the chip 80 and the overlapping portion of the chip 81 changes stepwise and decreases step by step from the center portion to an end of the chip. As a result, the generation of the streak due to the assembly error is reduced.

Figure 14:
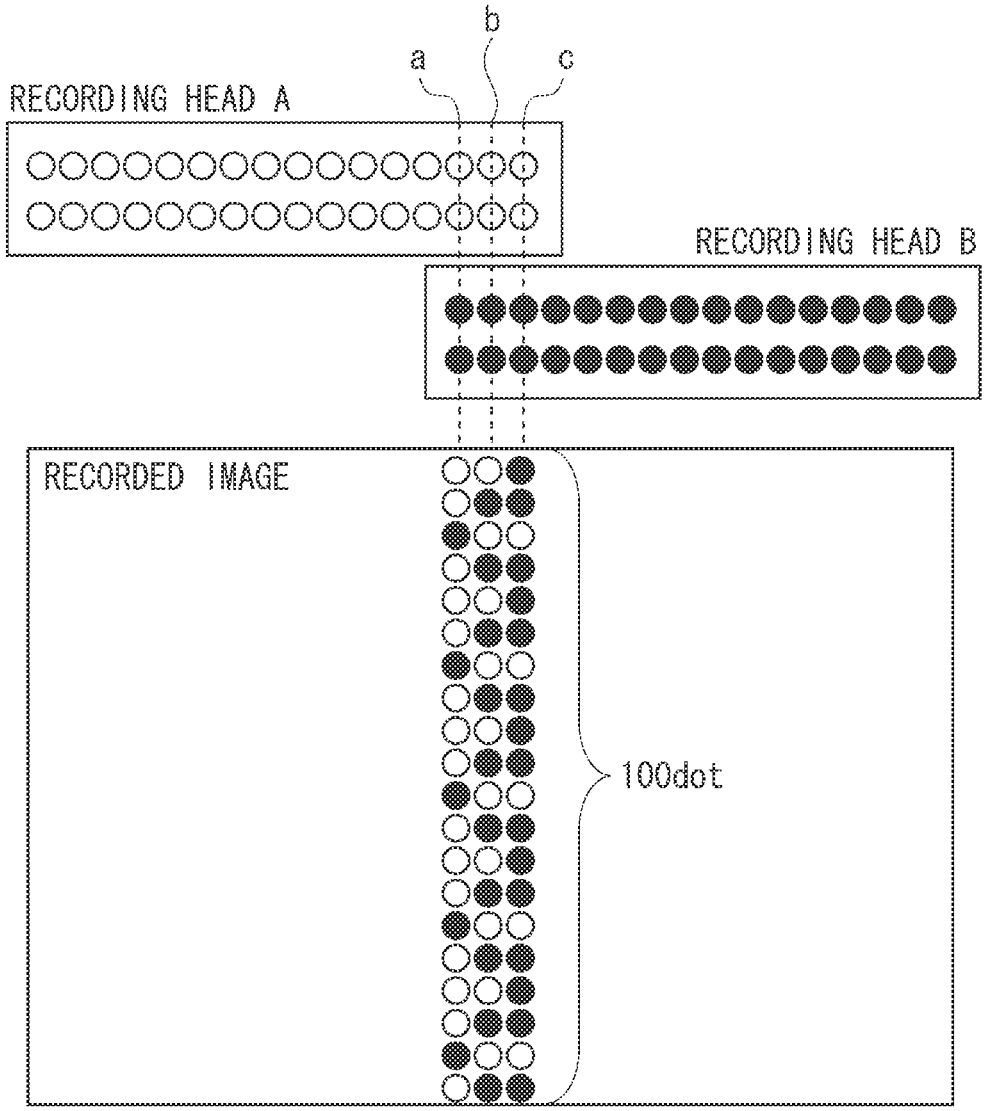
FIG. 14 illustrates distribution of the image data to the overlapping portion.

The discharge port distribution rate (distribution ratio) between the overlapping portions of each of the chips will be described below with reference to FIG. 14. According to the present invention, when the overlapping portions of the recording head record 100 dots of ink droplets on the recording medium, a ratio of the dots to be distributed to each of the chips will be referred to as the distribution ratio. More specifically, referring to FIG. 14, 75% of the image data is distributed to the chip 80 and 25% to the chip 81 in a line indicated by an arrow "a" in the recorded image.

Similarly, 50% of the image data is distributed to each of the chips 80 and 81 in a line indicated by an arrow "b", and 25% of the image data is distributed to the chip 80 and 75% to the chip 81 in a line indicated by an arrow "c" in the recorded image. According to the present exemplary embodiment, a mask is used as a distribution unit to distribute the image data according to such distribution rate. The distribution ratio of the dots thus becomes the discharge port distribution rate between the head chips. A method for controlling the discharge port distribution rate of the overlapping portions when recording the test pattern and when recording the data, which is a feature of the present exemplary embodiment, will be described below with reference to FIGS. 15A, 15B, and 15C.

Figures 15A, 15B, 15C:
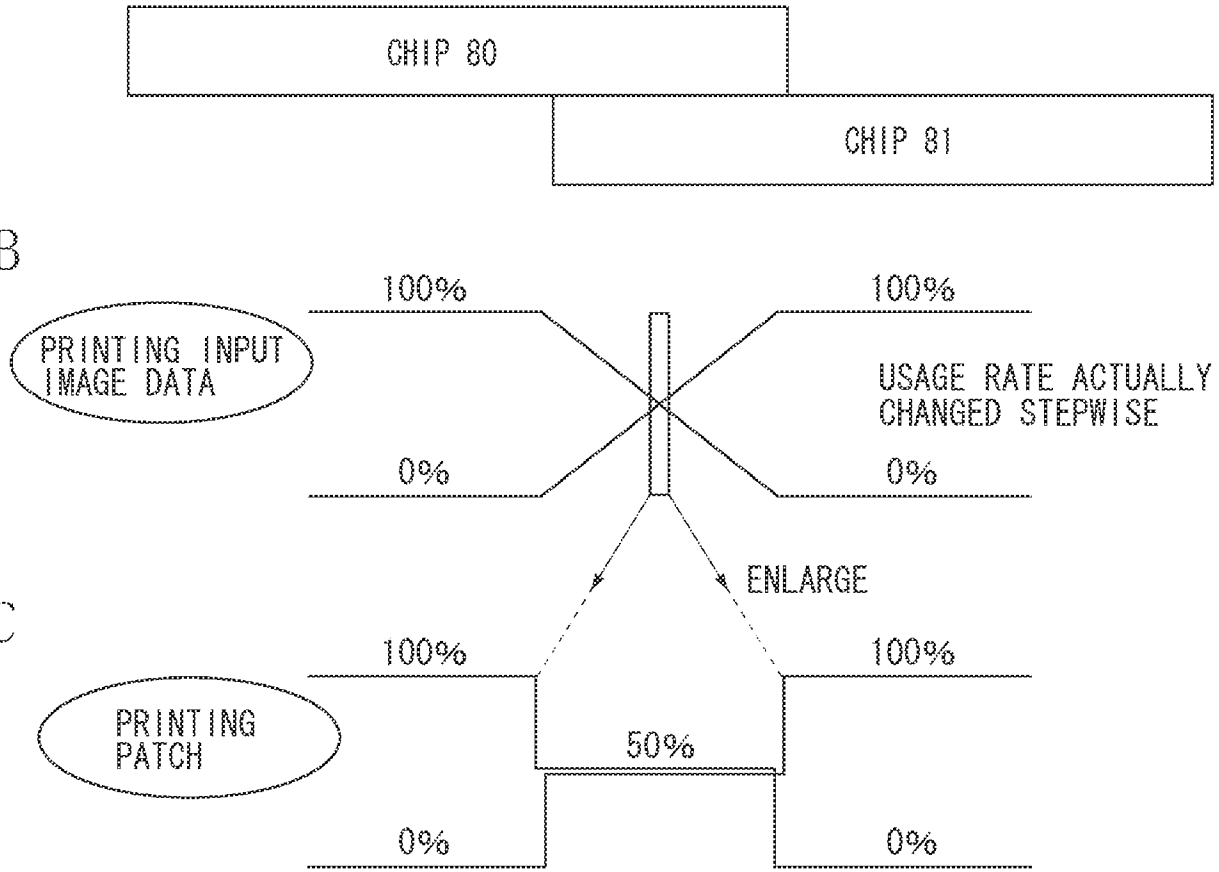
FIGS. 15A, 15B, and 15C illustrate the distribution ratios of the recording data when recording the test pattern.

When the inkjet recording apparatus records the test pattern, the data is distributed to the recording element arrays in each chip using a mask illustrated in FIG. 15C, i.e., a first distribution unit, that causes the distribution rate of the overlapping portions to be 50%-50%. Further, when the inkjet recording apparatus records the input image data, i.e., the image data other than the test pattern, the data is distributed to the recording element arrays in each chip using a gradation mask illustrated in FIG. 15B, i.e., a second distribution unit, that causes the distribution rate of the overlapping portions to change gradually.

Figure 4A:
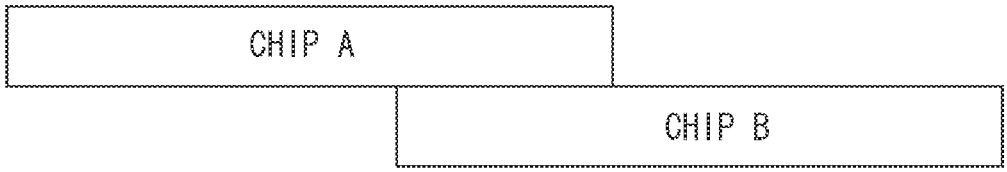
FIGS. 4A, 4B, 4C, 4*d*, and 4E illustrate image degradation caused by the overlapping portion.
Figure 4B:
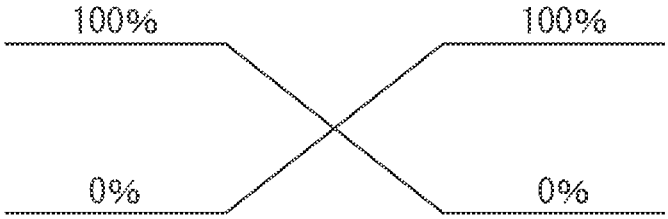
Figures 4C, 4D, 4E:
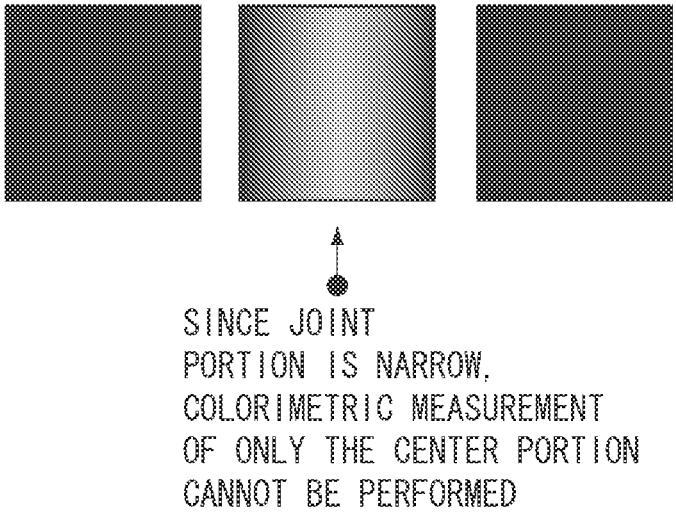

As described above, the streak generated by the assembly error can be reduced by using the gradation mask. However, since the discharge port distribution rate changes within the overlapping portions, the overlapping state of the dots becomes uneven, so that the color unevenness is generated in the recording image as illustrated in FIG. 4D. There is hardly any difference between the color in the boundary region of the overlapping portion and the non-overlapping portion and the color of the non-overlapping portion. However, the difference in the colors gradually increases towards the center of the overlapping portion, and the difference becomes greatest when the distribution rate of the overlapping portions becomes 50%-50%. The color deviation due to the displacement of the impact position and the overlapping of the dots, thus becomes the greatest at the center of the overlapping portions.

In general, when there is a difference between the colors of the different areas, the colors can be matched by the following method. The inkjet recording apparatus records the test pattern formed of patches of a plurality of colors in each area, performs colorimetric measurement of the test pattern to generate the color correction table, and performs color correction. However, if color unevenness is generated in the image recorded by the overlapping portions due to the gradation mask, it is difficult to further divide and perform calorimetric measurement on the recoded image of a very narrow width. As a result, the color unevenness in the image cannot be appropriately corrected.

To solve such a problem, according to the present exemplary embodiment, when recording the test pattern, a mask that distributes 50% of the image data to each overlapping portion is used instead of the gradation mask. The discharge port distribution rate between each of the chips thus becomes constant, and patches of an even color without color unevenness can be recorded.

Further, the color at the center of the patch recorded by the overlapping portions in which there is greatest color deviation with respect to the region in the patch recorded by the non-overlapping portion can be measured when using the gradation mask by distributing 50% of the image data to each chip. Furthermore, an amount of the difference between the colors is indicated by a difference in distance in a color space. The color correction data may thus be generated from the colorimetric data acquired by measuring the most displaced color at the center of the patch recorded by the overlapping portion and the color of region recorded by the non-overlapping portion. The color correction data to be used for other regions within the patch can then be generated by interpolating such color correction data.

<Colorimetric Method>

A method for performing colorimetric measurement on the recorded test pattern will be described below. According to the present exemplary embodiment, the colorimetric data is acquired using the optical measuring device 162 illustrated in FIG. 7. The colorimetric data indicates a characteristic such as a spectral intensity characteristics acquired using a spectral colorimeter Spectrolino by GretagMacbeth Corporation. The colorimetric data thus depends on a physical state of a light source which irradiates the patch or of the patch. Further, the colorimetric data may be acquired by scanning the image using an optical scanner and acquiring a signal value corresponding to the spectral reflectance characteristics.

<Color Correction Data Generation Method>

A method for generating the color correction data based on the colorimetric data will be described below. The color correction data includes all methods that allow the color to be corrected. For example, if color conversion using a matrix is to be performed, conversion coefficients that are matrix elements are determined. Further, if a three-dimensional look-up table is to be used, the table is determined. According to the present exemplary embodiment, the computer 161, i.e., the correction unit generates the color correction data.

Further, according to the present exemplary embodiment, an example in which the conversion coefficients of the matrix are determined from the colorimetric data of the patch will be described. The optical measuring device 162 performs colorimetric measurement of the patches recorded by the overlapping portion and the non-overlapping portion. An RGB value used for performing colorimetric measurement and reading the patches may be an arbitrary RGB value. However, it is necessary for both of the data to be of the same color space. For example, if the patch of the overlapping portion is to be read as RAW data, it is necessary to read the patch of the non-overlapping portion as the RAW data. A case where the acquired RGB values for both the patches recorded by the overlapping portion and the non-overlapping portion are standard RGB (sRGB) values will be described below.

The read sRGB value of patch recorded by the non-overlapping portion is converted to an XYZ value. An arbitrary high order matrix H is then generated from the read sRGB values of the patches recorded by the overlapping portion. For example, if there are n numbers of patches, and a first order matrix is to be generated, a matrix of n rows and three columns as illustrated in equation (1) is generated.

$$H = \begin{pmatrix} R_1 & G_1 & B_1 \\ R_2 & G_2 & B_2 \\ R_3 & G_3 & B_3 \\ \cdots & \cdots & \cdots \\ R_n & G_n & B_n \end{pmatrix} \tag{1}$$

Further, if a second order matrix is to be generated, a matrix of n rows and 10 columns as illustrated in equation (2) is generated. In equation 2, C is a constant term and may be added as necessary.

$$H = \begin{pmatrix} R_1 & G_1 & B_1 & R_1^2 & G_1^2 & B_1^2 & R_1G_1 & R_1G_1 & B_1G_1 & C_1 \\ R_2 & G_2 & B_2 & R_2^2 & G_2^2 & B_2^2 & R_2G_2 & R_2G_2 & B_2G_2 & C_2 \\ R_3 & G_3 & B_3 & R_3^2 & G_3^2 & B_3^2 & R_3G_3 & R_3G_3 & B_3G_3 & C_3 \\ \cdots & \cdots & \cdots & \cdots & \cdots & \cdots & \cdots & \cdots & \cdots & \cdots \\ R_n & G_n & B_n & R_n^2 & G_n^2 & B_n^2 & R_nG_n & R_nG_n & B_nG_n & C_n \end{pmatrix} \tag{2}$$

A pseudo inverse matrix I is then created from the created high order matrix H. For example, the pseudo inverse matrix I is created using a method discussed in Japanese Patent Application Laid-Open No. 2005-110089. A color correction matrix M is generated by setting as a target the XYZ value created by converting the RGB value of patch recorded by the non-overlapping portion from the created pseudo inverse matrix I. For example, the color correction matrix M is created using a method discussed in Japanese Patent Application Laid-Open No. 2005-110089.

An example of the sRGB value is described above. However, this is not a limitation in the actual application. According to the present example, the color of patch recorded by the overlapping portion is matched by referring to the color of the patch recorded by the non-overlapping portion. The reference side (i.e., the patch recorded by the non-overlapping portion) is converted to the XYZ color space or a Commission internationale de l'éclairage (CIE)-L*a*b* color space, regardless of the color space that the RGB value belongs to. A matrix which converts the RGB value of the side to be matched (i.e., the patch recorded by the overlapping portion) may be then generated. This is similar when the RGB value is RAW data, i.e., an RGB value that is device-dependent. In such a case, it is assumed that the read RGB value is a defined arbitrary RGB space (such as a sRGB space), and the conversion matrix may be then generated.

Any method for generating the color correction data may be employed in the above-described cases, as long as the read RGB value of the patch recorded by the overlapping portions is matched to the RGB value of the patch recorded by non-overlapping portion.

<Interpolation>

In the above-described color correction data generation method, colorimetric measurement is performed on the test pattern which is recorded using the mask that distributes the image data so that the distribution rate of the overlapping portions becomes 50%-50%. The color correction data for matching the color of the test pattern recorded by the overlapping portion to the color of the test pattern recorded by the non-overlapping portion is then generated based on the colorimetric result. On the other hand, when the image data other than the test pattern is to be recorded, the gradation mask is used so that the distribution rate gradually changes. Areas that are recorded by the overlapping portions in which the distribution rates are 10%-90% or 30%-70% thus exist.

It also becomes necessary to correct the colors recorded in such areas to match the color recorded by the non-overlapping portion. The color correction data applied to such areas may be generated by performing linear interpolation on the color correction data applied to the area recorded by the overlapping portions in which the distribution rate is 50%-50%.

The method for generating the color correction data to be applied to each of the areas recorded by the overlapping portions of different distribution rates will be described below. According to the present exemplary embodiment, the color correction data to be applied to the area recorded by the overlapping portions whose distribution rate is 50%-50% is the three-dimensional look-up table created based on the above-described matrix equation. The look-up tables for correcting the areas recorded by the overlapping portions in which the distribution rates are 90%-10%, 80%-20%, 70%-30%, and 60%-40% are generated from the look up table.

The RGB value of the image data to be input is converted using the created color correction look-up table for correcting the color recorded by the overlapping portions whose distribution rate is 50%-50%, to acquire R'G'B'. The input RGB value is then set as the value of the color recorded when the distribution rate of the overlapping portions is 100%-0%. Interpolation is thus performed using the converted R' G' B' data corresponding to the color recorded when the distribution rate is 50%-50%. As a result, the RGB signal values of colors recorded when the distribution rates are 90%-10%, 80%-20%, 70%-30%, and 60%-40% are acquired.

The acquired signal values are stored as the respective table values. Such a process is performed on all interpolation grids, so that the color correction table for all distribution rates can be acquired from the color correction table for the distribution rate of 50%-50%. As a result, when the recording data of each chip in the overlapping portions is generated using the gradation mask, the colors recorded by regions within the overlapping portions can be appropriately corrected.

If the table is previously created, recording can be performed at high speed. However, it becomes necessary to store the color correction tables of a plurality of distribution rates, so that there is an increase in the cost of the memory for storing the tables. To solve such a problem, interpolation may be performed by the above-described process when recording to acquire the correction data of the different distribution rates, instead of previously creating the tables.

As described above, the streak in which there is a great difference in color may be reduced by using the gradation mask with respect to the overlapping portions in the overlapping head. However, it is difficult to perform colorimetric measurement of the color unevenness generated in the area recorded by the overlapping portion. According to the present exemplary embodiment, the gradation mask is used when recording the image data. Further, the mask which distributes the image data so that the distribution rate becomes 50%-50% is used when recording the test pattern to generate the data for the overlapping portion of each head chip to perform recording. As a result, the test pattern on which colorimetric measurement is performable can be recorded to correct the color unevenness.

According to the present exemplary embodiment, a case where there are inks of four colors is described. However, the number of colors of ink is not limited to four, and may be greater or less than four. Further, according to the present exemplary embodiment, the gradation expression of surface-area gradation of one pixel is described as five gradations. However, the number of gradations is not limited to five.

Furthermore, according to the present exemplary embodiment, when the image data is corrected using the color correction data, linear interpolation is employed for correcting the color recorded by each region in the overlapping portion. However, the method for interpolating the color correction data may use other interpolation methods.

Moreover, when a usage rate of the discharge ports in the non-overlapping portion when recording the image data or the test pattern is set to 100%, the data to be recorded by the overlapping portions of the two chips is generated so that a sum of the distribution rate of the overlapping portions becomes 100%.

However, the present invention is not limited to the above, and it is not necessary for the sum of the distribution rate to be 100%, and may be less than 100%. The distribution rate is based on the color recorded by the overlapping portions, and an amount of ink bleeding and a penetration speed are different depending on the type of ink or the recording medium.

For example, the gradation mask for the overlapping portions may be designed so that the sum of the distribution rate becomes 110%. In such a case, colorimetric measurement is performed on the patch recorded by the overlapping portions whose distribution rate is 55%-55%, i.e., the distribution rate for recording an area in which the difference in the colors is the greatest.

Further, according to the present exemplary embodiment, when the usage rate of the non-overlapping portion is set to 100%, the area recorded by the overlapping portions in which the color difference becomes the greatest is the area recorded when 50% of the image data is distributed to each of the overlapping portions. The patch is thus recorded using such distribution rate, and the colorimetric data is acquired. However, the distribution rate of the overlapping portions for recording the patch is not limited to 50%-50%.

According to the present exemplary embodiment, when the interpolation method is employed, the color correction data to be applied to areas of other distribution rates in addition to the area on which colorimetric measurement is performed can be created. Such color correction data can be created by performing linear interpolation when there is colorimetric data of two areas, i.e., areas recorded by the non-overlapping portion and the overlapping portions of arbitrary distribution rate. For example, the patches are recorded in the area of the non-overlapping portion (100%) and the area where the distribution rate of the overlapping portions is 90%-10%. The color correction data of the other areas (of distribution rates 50%-50% and 60%-40%) can then be created.

Further, according to the above-described method, the correction is performed to match the color of the patch recorded by the overlapping portions to the color of the patch recorded by the non-overlapping portion. However, the correction unit may be applied to either the overlapping portions or the non-overlapping portion. In general, whether matching the color from the overlapping portions to the non-overlapping portion or from the non-overlapping portion to the overlapping portions is of higher accuracy, depends on the image signal to be printed.

Furthermore, a target color table may be previously stored in a ROM, and the color correction data for matching the colors of patches recorded by both the non-overlapping portion and the overlapping portions to the target value may be created.

According to the present exemplary embodiment, when the test pattern is recorded, the discharge port distribution rate is determined to be constant at 50% between each of the two chips along a direction in which the discharge port arrays are aligned (i.e., the predetermined direction). However, the present invention is not limited to the above, and when the number of dots to be recorded is an odd number, the distribution rate cannot be 50%-50%. In such a case, the data is distributed so that the amount of change in the distribution rate from the center to the end of the discharge port arrays becomes approximately constant. As a result, the color deviation due to the displacement of the impact position can be more accurately measured.

Further, the data may be distributed so that the amount of change in the discharge port distribution rate when recording the test pattern becomes smaller than an amount of change when recording the image data other than the test pattern. Furthermore, the data may be distributed so that the number of recording elements in which the amount of change in the discharge port distribution rate when recording the test pattern becomes greater than when recording the image data other than the test pattern. The colorimetric measurement of the test pattern can be performed with high accuracy by employing such a method.

Figure 16:
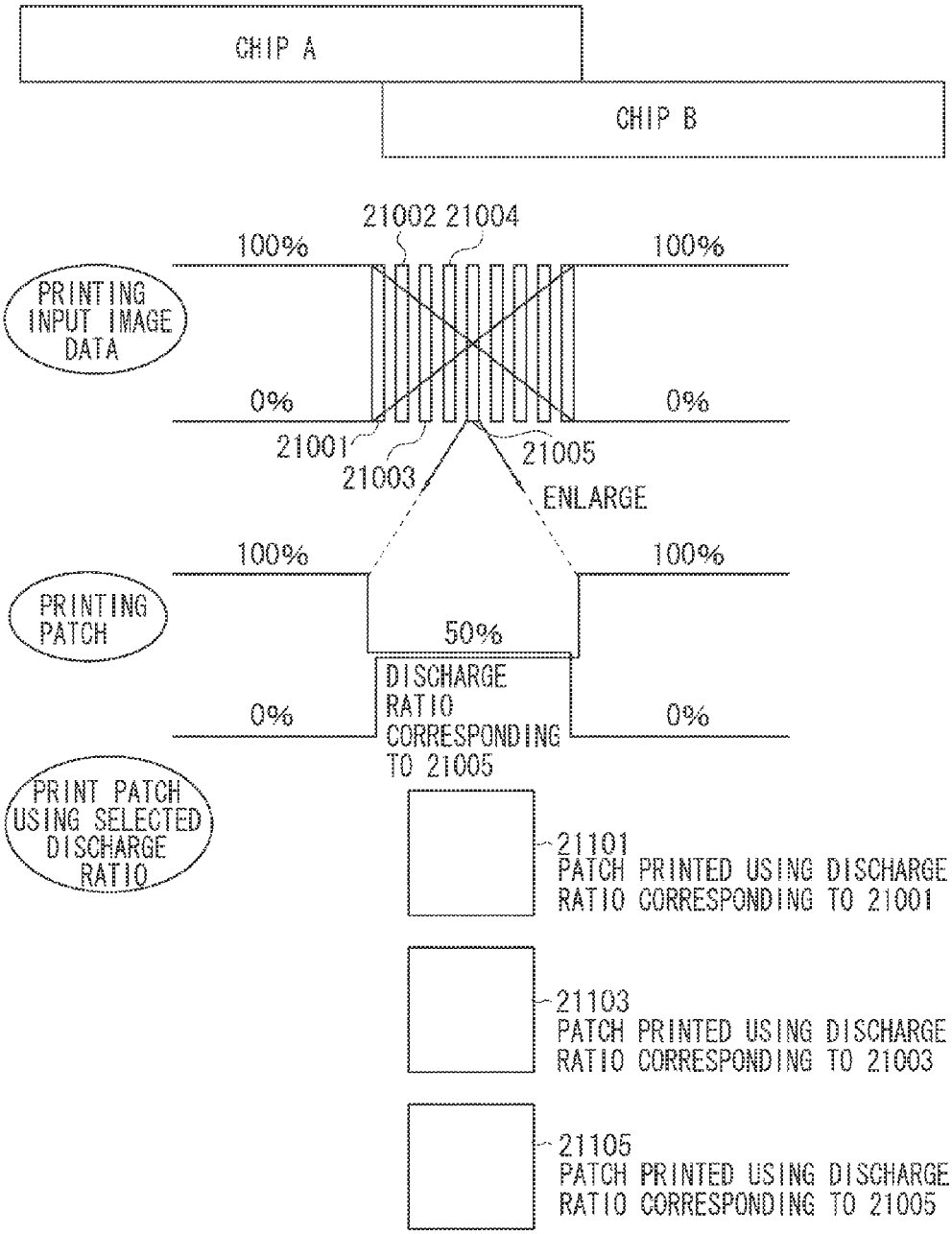
FIG. 16 illustrates the distribution ratios of the recording data when recording the test pattern according to another exemplary embodiment of the present invention.

According to the above-described exemplary embodiment, the patch of the area in which the color deviation is greatest in the color unevenness of the overlapping portion whose the distribution rate is 50%-50%, is recorded. The color correction data is then generated, and interpolation is further performed on the color correction data to generate the color correction data for correcting the color of the areas other than to above area. In such a case, the test pattern is recorded and is performed colorimetric measurement for each combination of the distribution rates of a plurality of discharge ports as illustrated in FIG. 16. The color correction data is generated without interpolation, so that color correction can be performed with high accuracy.

Further, according to the above-described exemplary embodiment, a case where the colors recorded in the non-overlapping portion in the overlapping head are the same. However, there is a case where a discharge amount becomes different due to an error when manufacturing the head, so that the color recorded by the non-overlapping portions may become different. In such a case, calibration may be performed using a calibration pattern recorded by the non-overlapping portion, and the above-described color correction according to the present invention may then be performed. The color may be corrected to match a predetermined reference color value or to match a color value of either of the heads.

Figure 17:
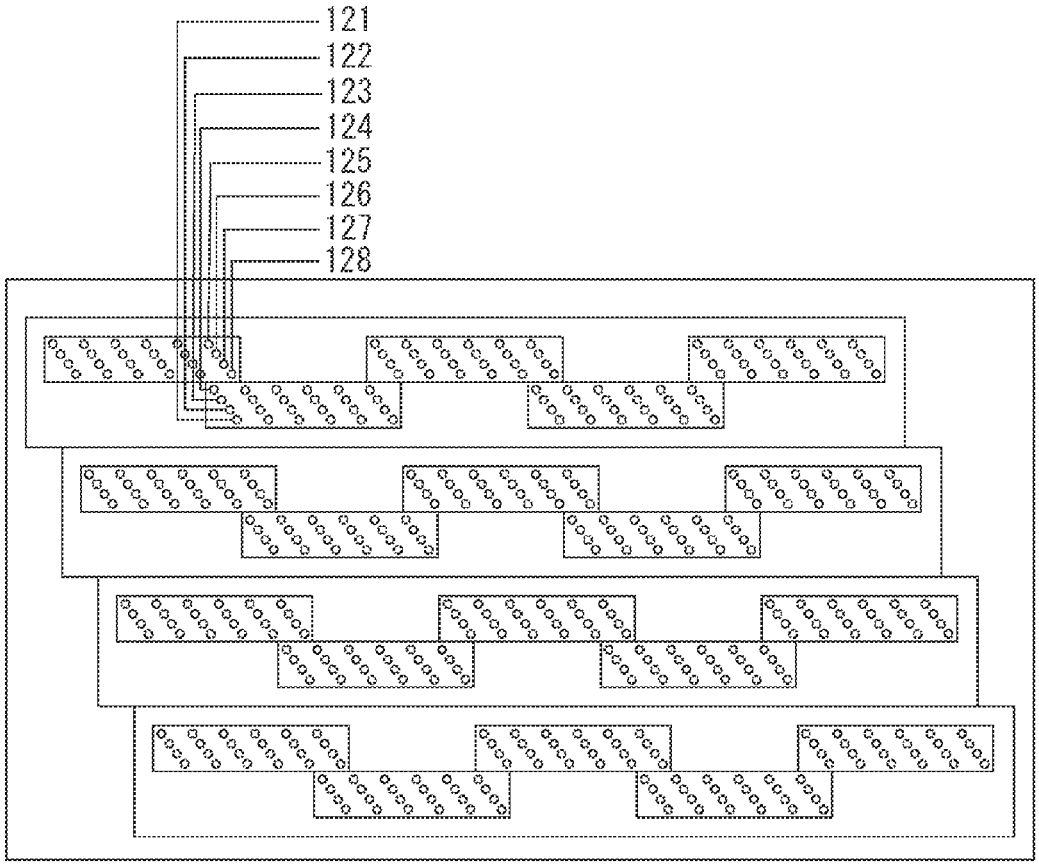
FIG. 17 illustrates the overlapping head according to another exemplary embodiment of the present invention.

Furthermore, according to the above-described exemplary embodiment, the overlapping portions of the heads that discharge inks of all colors as illustrated in FIG. 8 are at the same positions. However, the present invention is not limited to the above. For example, the position of the overlapping portion may be different for each color ink as illustrated in FIG. 17. However, in such a case, it is necessary to record the test pattern for each area in which the characteristics of the overlapping portion and the non-overlapping portion of the recording head are different, and perform color correction.

Figure 18:
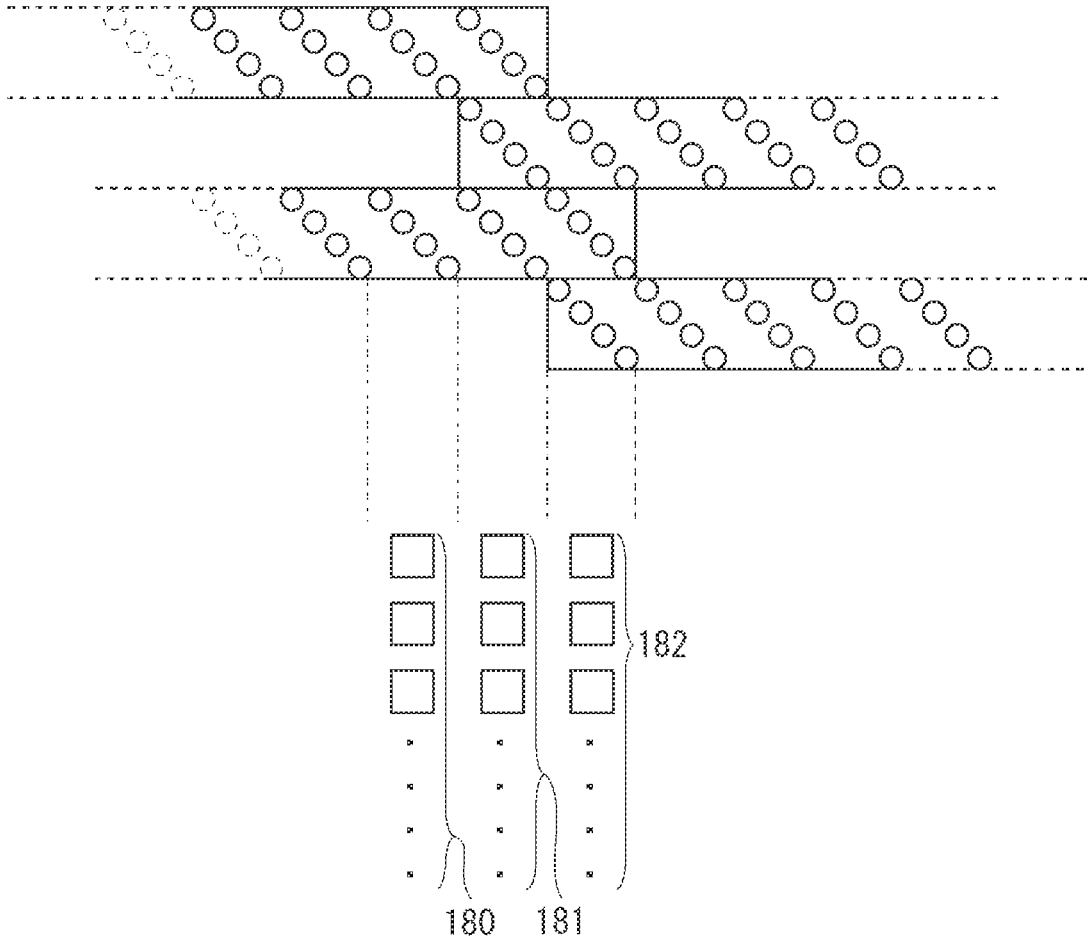
FIG. 18 illustrates the test pattern according to another exemplary embodiment of the present invention.

If the position of the overlapping portion is different for each ink color as illustrated in FIG. 18, the colors of a chip group 180, a chip group 181, and a chip group 182 become different. More specifically, the colors become different due to a change in the overlapping of the dots of different ink colors caused by the impact position displacement for secondary colors, even when the colors are the same when recording a single color using the non-overlapping portions of the recording head.

According to the above-described exemplary embodiment, recording is performed by conveying the recording medium with respect to the recording head. However, the present invention is not limited to the above. Recording may be performed by relative scanning between the recording head and the recording medium, so that the recording head may perform scanning. Further, the present invention is not limited to a recording head which performs recording by discharging ink, as long as the recording element arrays are arranged in the recording head so that there is an overlapping portion.

Furthermore, according to the above-described exemplary embodiment, an inkjet recording system receives from the computer, i.e., an external supplying device, the test pattern data and the image data. The system then uses an external colorimetric device and performs colorimetric measurement on the test pattern, and generates the color correction data using the computer. However, the present invention is not limited to the above, and the inkjet recording apparatus may store the image data, may include the colorimetric device, and may store a program that generates the color correction data.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-290108 filed Dec. 22, 2009, which is hereby incorporated by reference herein in its entirety.

What is claimed is:

1. A recording apparatus comprising:

a recording unit configured to record an image on a recording medium using a recording head in which a first recording element array including a plurality of recording elements aligned along a predetermined direction and a second recording element array including a plurality of recording elements aligned along the predetermined direction, are arranged to be displaced in the predetermined direction so that there is an overlapping portion formed by an end of the first recording element array and an end of the second recording element array overlapping along a direction intersecting with the predetermined direction;

a first distribution unit configured to distribute test pattern data to a first recording element array and a second recording element array in the overlapping portion;

a generation unit configured to generate, based on a colorimetric result of a test pattern recorded according to data distributed by the first distribution unit, recording data corresponding to an image that is different from the test pattern;

a second distribution unit configured to distribute recording data generated by the generation unit to the first recording element array and the second recording element array in the overlapping portion; and a control unit configured to control the first distribution unit and the second distribution unit so that a number of recording elements corresponding to an approximately constant distribution rate, among distribution rates of the first recording element array and the second recording element array in the predetermined direction, set by the first distribution unit, becomes larger than a number of recording elements corresponding to an approximately constant distribution rate, among distribution rates of the first recording element array and the second recording element array in the predetermined direction, set by the second distribution unit.

2. A recording system including a recording apparatus configured to record an image on a recording medium using a recording head in which a first recording element array including a plurality of recording elements aligned along a predetermined direction and a second recording element array including a plurality of recording elements aligned along the predetermined direction, are arranged to be displaced in the predetermined direction so that there is an overlapping portion formed by an end of the first recording element array and an end of the second recording element array overlapping along a direction intersecting with the predetermined direction, and a data supplying apparatus configured to supply recording data to the recording apparatus, the recording system comprising:

a first distribution unit configured to distribute test pattern data to a first recording element array and a second recording element array in the overlapping portion;

a generation unit configured to generate, based on a colorimetric result of a test pattern recorded according to data distributed by the first distribution unit, recording data corresponding to an image that is different from the test pattern;

a second distribution unit configured to distribute recording data generated by the generation unit to a first recording element array and a second recording element array in the overlapping portion; and a control unit configured to control the first distribution unit and the second distribution unit so that a number of recording elements corresponding to an approximately constant distribution rate, among distribution rates of the first recording element array and the second recording element array in the predetermined direction, set by the first distribution unit, becomes larger than a number of recording elements corresponding to an approximately constant distribution rate, among distribution rates of the first recording element array and the second recording element array in the predetermined direction, set by the second distribution unit.

3. An image processing method comprising:

a first assigning step of assigning test pattern data for printing a test pattern to first and second printing element groups, a plurality of printing elements included in the first printing element group being in a part of a first printing element array in which the printing elements are aligned along a predetermined direction, a plurality of printing elements included in the second printing element group being in a part of a second printing element array in which printing elements are aligned along the predetermined direction, the printing elements included in the second printing element group and the printing elements included in the first printing element group being used to print an image in a predetermined area on a printing medium, the first and second printing element arrays being displaced in the predetermined direction and aligned in a direction intersecting with the predetermined direction so that an overlap portion is formed, the first printing element group and the second printing element group being included in the overlap portion;

wherein the test pattern data is assigned to each of the printing elements of the first printing element group at a first rate, and the test pattern data is assigned to each of the printing elements of the second printing element group at a second rate, and a second assigning step of assigning image data corrected based on a measurement result of the test pattern printed according to the test pattern data by using the first and second printing element groups to the first and second printing element groups, wherein the image data is assigned to each of the printing elements of the first printing element group at a third rate, and the image data is assigned to each of the printing elements of the second printing element group at a fourth rate, wherein a difference between the first rate of a printing element at one end of the first printing element group and the first rate of a printing element at the other end of the first printing element group in the first assigning step is smaller than a difference between the third rate of the printing element at the one end of the first printing element group and the third rate of the printing element at the other end of the first printing element group in the second assigning step.

4. The image processing method according to claim 3, wherein the difference of the third rate and the fourth rate in the second assigning step is substantially zero.

5. The image processing method according to claim 3, wherein a total of the first rate and the second rate in the first assigning step is 100 percent at any position of the overlap portion in the predetermined direction.

6. The image processing apparatus according to claim 3, wherein a total of the third rate and the fourth rate in the second assigning step is 100 percent at any position of the overlap portion in the predetermined direction.

7. The image processing apparatus according to claim 3, wherein a difference between the second rate of the printing element at the one end of the second printing element group and the second rate of the printing element at the other end of the second printing element group in the first assigning step is smaller than a difference between the fourth rate of the printing element at the one end of the second printing element group and the fourth rate of the printing element at the other end of the second printing element group in the second assigning step.

8. The image processing apparatus according to claim 3, wherein the first rate decreases in accordance with a position of the printing element of the first printing element group in the predetermined direction changing from the one end of the first printing element group to the other end of the first printing element group, and wherein the second rate increases in accordance with a position of the printing element of the second printing element group in the predetermined direction changing from the one end of the second printing element group to the other end of the second printing element group.

9. The image processing apparatus according to claim 3, wherein the third rate is substantially constant in accordance with a position of the printing element of the first printing element group in the predetermined direction changing from the one end of the first printing element group to the other end of the first printing element group, and wherein the fourth rate is substantially constant in accordance with a position of the printing element of the second printing element group in the predetermined direction changing from the one end of the second printing element group to the other end of the second printing element group.

10. An image processing apparatus comprising:

an assigning unit configured to assign data for printing an image in a predetermined area on a printing medium to first and second printing element groups, a plurality of printing elements included in the first printing element group being in a first printing element array in which the printing elements are aligned along a predetermined direction, a plurality of printing elements included in the second printing element group being in a part of a second printing element array in which printing elements are aligned along the predetermined direction, the printing elements included in the second printing element group and the printing elements included in the first printing element group being used to print an image in a predetermined area on a printing medium, the first and second printing element arrays being displaced in the predetermined direction and aligned in a direction intersecting with the predetermined direction so that an overlap portion is formed, the first printing element group and the second printing element group being included in the overlap portion; and a printing unit configured to print an image on the printing medium based on a result of assignment by the assigning unit, wherein the image data is assigned to each of the printing elements of the first printing element group at a third rate, and the image data is assigned to each of the printing elements of the second printing element group at a fourth rate, wherein the assigning unit assigns test pattern data for printing a test pattern at a first rate to each of the printing elements of the first printing element groups, and at a second rate to each of the printing elements of the second printing element groups, and wherein the assigning unit assigns image data corrected based on a measurement result of the test pattern printed according to the test pattern data at the third rate to each of the printing elements of the first printing element groups and at the fourth rate to each of the printing elements of the second printing element groups, and wherein difference between the first rate of a printing element at one end of the first printing element group and the second a printing element at the other end of the first printing element group in the first assigning step is smaller than a difference between the third rate of the printing element at the one end of the second printing element group and the fourth rate of the printing element at the other end of the second printing element group in the second assigning step.

11. The image processing apparatus according to claim 10, further comprising an obtaining unit configured to obtain the measurement result.

12. An image processing method comprising:

a first assigning step of assigning test pattern data for printing a test pattern to first and second printing element groups, the first printing element group consisting of some of printing elements in a first printing element array in which the printing elements are aligned along a predetermined direction, the second printing element group consisting of printing elements in a part of a second printing element array in which printing elements are aligned along the predetermined direction, the printing elements included in the second printing element group and the printing elements included in the first printing element group being used to print an image in a predetermined area on a printing medium, the first and second printing element arrays being displaced in the predetermined direction and aligned in a direction intersecting with the predetermined direction; and a second assigning step of assigning image data corrected based on a measurement result of the test pattern printed according to the test pattern data by using the first and second printing element groups in the first assigning step to the first and second printing element groups, wherein an amount of change in the predetermined direction in a rate for assigning the test pattern to the second printing element group in the first assigning step is smaller than an amount of change in the predetermined direction in a rate for assigning the image data to the second printing element group in the second assigning step.

13. An image processing method comprising:

a first assigning step of assigning test pattern data for printing a test pattern to first and second printing element groups, the first printing element group consisting of some of printing elements in a first printing element array in which the printing elements are aligned along a predetermined direction, the second printing element group consisting of printing elements in a part of a second printing element array in which printing elements are aligned along the predetermined direction, the printing elements included in the second printing element group and the printing elements included in the first printing element group being used to print an image in a predetermined area on a printing medium, the first and second printing element arrays being displaced in the predetermined direction and aligned in a direction intersecting with the predetermined direction; and a second assigning step of assigning image data corrected based on a measurement result of the test pattern printed according to the test pattern data by using the first and second printing element groups in the first assigning step to the first and second printing element groups, wherein a number of printing elements with which the rate for assigning the test pattern to the second printing element group in the first assigning step is approximately constant in the predetermined direction is larger than a number of printing elements with which the rate for assigning the image data to the second printing element group in the second assigning step is approximately constant in the predetermined direction.

* * * * *